US005871148A

United States Patent [19]

Hafer et al.

[11] Patent Number: 5,871,148

[45] Date of Patent: Feb. 16, 1999

[54] BULK BOX CONTAINER WITH SUPPORTING SIDE BEAMS

[76] Inventors: Harold Franklin Hafer, 26572 Morena Dr., Mission Viejo, Calif. 92691; Peter Roman Apostoluk, 131 E. Frenchman's Bend, Monroe, La. 71203

[21] Appl. No.: 596,473

[22] Filed: Feb. 5, 1996

[51] Int. Cl.[6] ..... B65D 5/50

[52] U.S. Cl. ..... 229/199; 229/919; 493/89

[58] Field of Search ..... 229/23 C, 199, 229/919; 493/89, 297

[56] References Cited

U.S. PATENT DOCUMENTS

| | | | |
|---|---|---|---|
| 2,315,105 | 3/1943 | Bonfield | 229/199 |
| 2,378,161 | 6/1945 | Sawyer . | |
| 3,136,472 | 6/1964 | Waller et al. | 229/23 C |
| 3,159,326 | 12/1964 | Stonebanks | 229/23 C |
| 3,315,867 | 4/1967 | Seltman | 229/199 |
| 3,372,855 | 3/1968 | Smith | 229/23 C |
| 3,536,245 | 10/1970 | Palmer | 229/199 |
| 3,543,991 | 12/1970 | George . | |
| 3,583,626 | 6/1971 | Overton et al. | 229/23 C |
| 3,648,920 | 3/1972 | Stump | 229/199 |
| 3,715,072 | 2/1973 | Muskopf . | |
| 3,831,836 | 8/1974 | Ellison et al. | 229/199 |
| 4,019,635 | 4/1977 | Boots . | |
| 4,081,124 | 3/1978 | Hall | 229/199 |
| 4,115,909 | 9/1978 | Corella . | |
| 4,194,652 | 3/1980 | Williamson . | |
| 4,356,933 | 11/1982 | Connolly . | |
| 4,366,905 | 1/1983 | Forshee . | |
| 4,834,255 | 5/1989 | Boots . | |
| 4,840,282 | 6/1989 | Gerhard . | |
| 4,854,462 | 8/1989 | Gerhard . | |
| 4,901,885 | 2/1990 | Boots . | |
| 4,903,859 | 2/1990 | Derby . | |
| 4,927,037 | 5/1990 | Boots . | |
| 5,025,925 | 6/1991 | Wiklund . | |
| 5,052,579 | 10/1991 | Boots . | |
| 5,071,025 | 12/1991 | Boots . | |
| 5,282,544 | 2/1994 | Boots . | |
| 5,289,937 | 3/1994 | Boots . | |
| 5,407,090 | 4/1995 | Boots . | |
| 5,437,384 | 8/1995 | Farrell . | |
| 5,450,998 | 9/1995 | Esse et al. | 229/919 |

FOREIGN PATENT DOCUMENTS

| | | | |
|---|---|---|---|
| 916768 | 12/1946 | France | 229/199 |
| 3838781 | 5/1990 | Germany | 229/199 |
| 2226546 | 7/1990 | United Kingdom | 229/199 |

*Primary Examiner*—Gary E. Elkins
*Attorney, Agent, or Firm*—Domingue, Delaune & Waddell

[57] ABSTRACT

A square or rectangular bulk shipping container made of rigid packaging material having supporting side beams positioned vertically about the side wall panels of the container. The side beams are made of a rigid material and act to distribute lateral bulge forces evenly throughout the container to prevent bulging.

24 Claims, 6 Drawing Sheets

BULK BOX CONTAINER WITH SUPPORTING SIDE BEAMS

FIELD OF THE INVENTION

The present invention relates to bulk containers and in particular, square or rectangular bulk containers made of rigid packaging material which have supporting vertical side beams to prevent bulging of the container when loaded with flowable materials.

BACKGROUND OF THE INVENTION

To store and transport flowable materials such as grain, chemicals, fertilizers and minerals, intermediate or semi bulk shipping containers have been developed. These containers are often square or rectangular in design and constructed of a rigid material, such as corrugated paper board. The containers hold approximately 1,000 to 3,000 lbs. or more of bulk material and because of their economical design, are readily stacked for high density storage or transportation.

As a result of the inherent properties of flowable or bulk material, bulk material exerts a lateral force upon the side wall panels of bulk containers. The box like shape of the containers do not permit the uniform distribution of the lateral forces. Hence, bulging of the container may result. Bulging is an undesired effect as it distorts the containers causing a loss of storage space when the containers' are stacked together. In the extreme, bulging can cause rupture of the containers and a spilling of the containers' contents. This is especially undesired when the contents are chemical in composition.

To compensate for the lateral forces exerted by the flowable materials, square or rectangular (i.e, box) rigid bulk containers are made of durable material (e.g., reinforced corrugated paper board) which are capable of withstanding the lateral forces. Such durable material is more expensive than standard packaging material. Moreover, the manufacture of the rigid containers is more complex as a result of construction techniques designed to add strength to the containers to compensate for the lateral forces.

U.S. Pat. Nos. 3,543,991 and 3,715,072 each describe a rectangular shaped rigid bulk container. Three individual cells are formed from corrugated paper board and may contain both a bottom and top closure flaps. The cells are placed in side by side relation and are interconnected via attachment of respective adjacent panels. Reinforcing side panels may be positioned to overlie the external side panel of the first and third cells. A bottom tray and top tray may be placed over the respective top and bottom ends of the container. U.S. Pat. No. 3,715,072 further describes the adhesion of reinforcing sheets between adjacent side walls of individual cells to enhance bulge resistance and to distribute pressure uniformly along the adjacent side walls of the cells.

The rectangular shaped rigid intermediate bulk containers of the type described in U.S. Pat. Nos. 3,543,991 and 3,715,072 are more expensive as a result of manufacturing costs due to the composition of the containers necessitated by the square or rectangular design (which does not uniformly distribute the lateral forces exerted by the flowable material) and the overall complexity of the configured containers. Moreover, these containers are still susceptible to bulging, despite their construction.

As an alternative, hybrid bulk containers have been developed which combine rigid square or rectangular containers and circular flexible bulk containers. U.S. Pat. Nos. 4,834,255; 4,901,885; 4,927,037; 5,052,579; 5,071,025; 5,282,544; 5,289,937; and 5,407,090 each describe a bulk container having an outer rigid container of rectangular design and an inner circular flexible container. The inner circular flexible container functions to deflect the lateral forces exerted by the flowable materials (which are chiefly contained within the flexible container) and relieve the bulge pressure, which in a standard rigid container would have been exerted against the container's side walls. Again, this configuration suffers from the disadvantages of increased costs and complexity.

It is therefore an object of the present invention to overcome the draw backs associated with bulging of rigid rectangular or square bulk containers under load. This object is achieved through the use of vertical side beams positioned about the side wall panels of the bulk container.

SUMMARY OF THE INVENTION

The object of the present invention is achieved by providing a rigid rectangular or square bulk container having vertically placed rigid side beams positioned about the side wall panels of the container. The side beams are connected at the top and at the bottom of the container in such a manner that the side beams bear the lateral forces of the flowable materials being contained and transfer those forces vertically to the top and bottom of the container as well as horizontally to the side wall panels.

The rigid side beams may be formed in a variety of shapes and may be composed of numerous materials. However, the shape and composition of the rigid side beams must function to transfer force longitudinally with relatively little deflection. A preferred shape for the rigid side beams is a triangular or V shaped profile as the material to strength ratio makes this shape economically feasible. A 45 degree angle at the apex is preferred, with the apex preferably pointing towards the center of the container. A commercially available product known as "angle board" or "edge board" would be suitable for constructing the side beams. It has a V shaped profile and is made of paper fiber or plastic.

The side beams may be held in place by a variety of fastening mechanisms. The use of an adhesive to affix the side beams to the side wall panels of the container may be employed. Additionally, the side wall panels may contain sleeves or pockets which receive the side beams and hold them in position about the side walls panel. Laminating the side beams to the side wall panels is also possible. Perhaps most feasible is an embodiment wherein the side beams are folds within the side wall panels themselves or are folds within an inner lining which fits within the container.

The spacing and number of side beams is dependent on the characteristics of the flowable material that is to be contained. Ideally, the spacing and number of side beams should result in bulge or lateral force being diverted equally. This is often accomplished by using eight side beams paired into sets of two which are spaced at or near the center of each side wall panel. The side beams act to transfer the lateral bulge forces away from the side wall panels and to the top of the container. This is accomplished by connecting the top ends of the side beams at or near the top panel of the container.

DETAILED DESCRIPTION OF PREFERRED EMBODIMENTS

Figure 1:
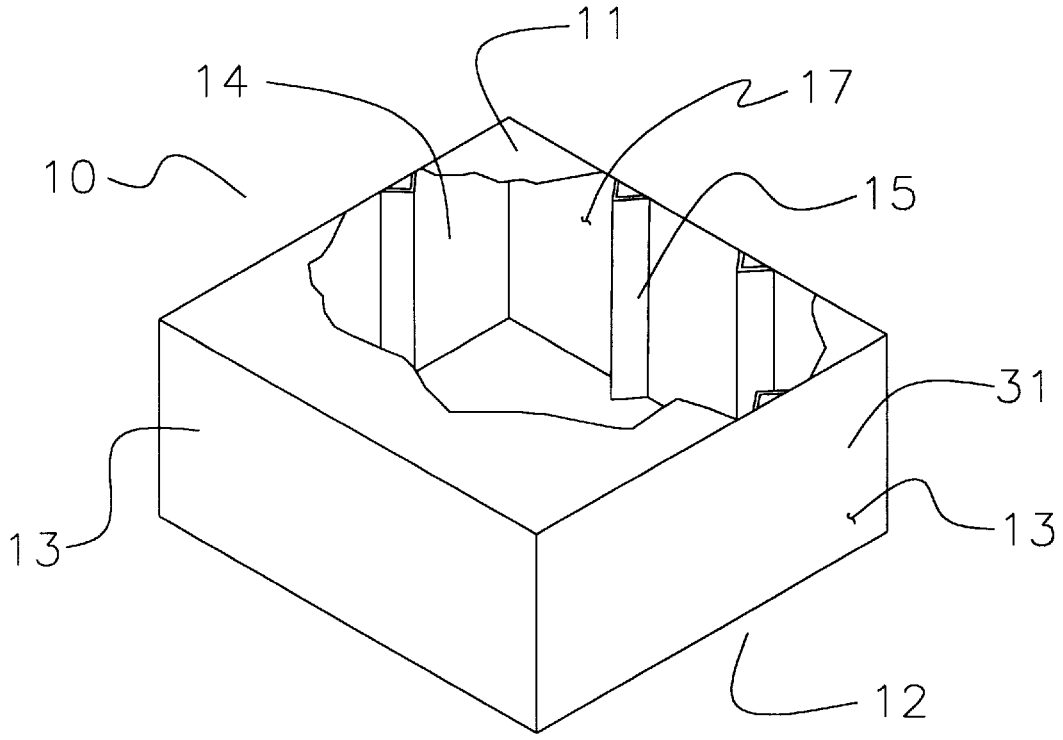
FIG. 1 is an isometric, cut away view of a first embodiment of the bulk box container showing the side beams placed on the inner surface of the side wall panels.

With reference to the figures where like elements have been given like numerical designation to facilitate an understanding of the present invention, and particularly with reference to the embodiment of the bulk container of the present invention illustrated in FIG. 1, the bulk container may be constructed as a box 10 made of a substantially rigid packaging material. Box 10 may have a top panel 11 and bottom panel 12 interconnected by four side wall panels 13 which defines a chamber 14 for flowable bulk materials. Preferably, at least one side beam 15 extends in a substantially vertical direction about each of the four side wall panels 13 in spaced relation. various rigid packaging materials may be used to construct box 10. For example, box 10 may be made of corrugated paper board, plastic or metal. Preferably, box 10 is made from corrugated paper board.

Figure 2:
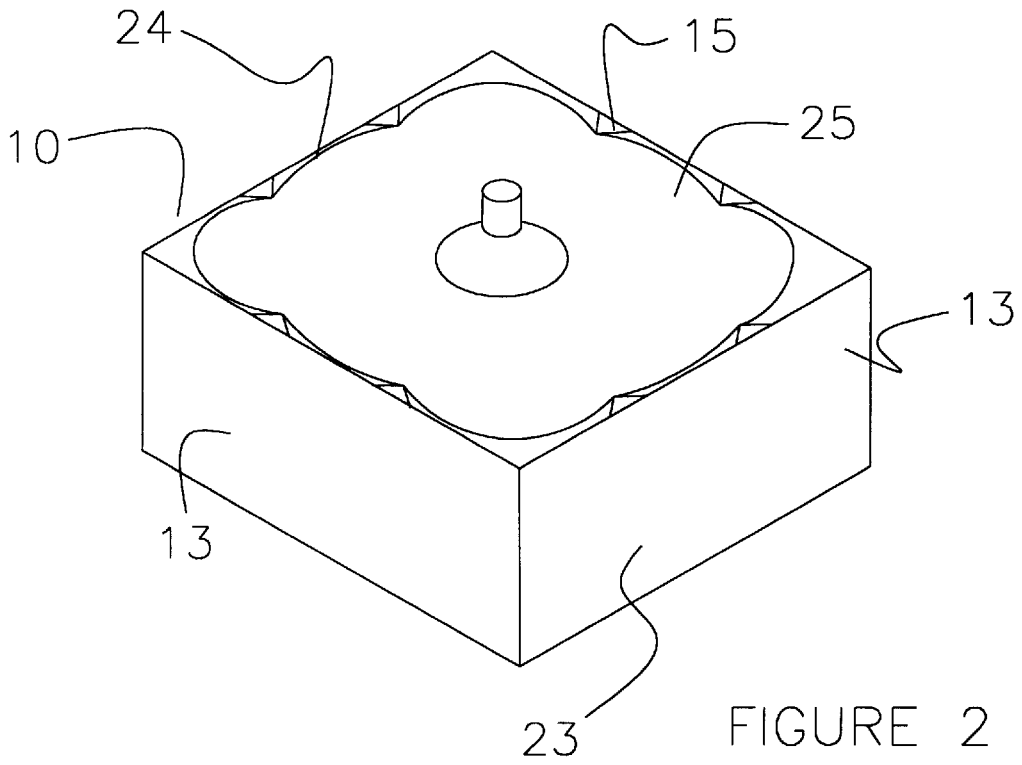
FIG. 2 is a schematic view of the first embodiment of the bulk box container showing the placement of a plastic inner lining with in the chamber of the container.

As seen in FIG. 2, box 10 may also be formed of multiple layers. For example, box 10 may be composed of a layer 23 of relatively rigid permeable material, such as paper board, and a layer of relatively impermeable material 24. The relatively impermeable material may be an external or internal coating. Preferably, layer 24 of relatively rigid impermeable material is a synthetic film material. Examples of synthetic film materials include polyethylene, polypropylene, polyvinyl chloride, polyurethane, nylon and polyesters. Layer 24 of relatively impermeable material may also be in the form of a separate plastic inner liner 25 which is placed within chamber 14 of box 10.

The construction of box 10 may be accomplished using standard techniques known to skilled artisans. Various methods may be utilized to join the ends of four side wall panels 13 as well as interconnect top and bottom panel 11, 12 to side wall panels 13. The construction techniques employed to construct box 10 may depend upon the type of rigid packaging material used to form box 10. For instance, in an embodiment in which box 10 is made of metal, welding may be used to join side wall panels 13 and top and bottom panel 11, 12. Moreover, box 10 may be preformed and require only the folding of the various panels to form box 10. This type of construction has application in the situation where box 10 is made of paper board or plastic.

With reference to FIG. 1, it is preferred if two side beams 15 extend substantially vertically about each of side wall panels 13. FIG. 1 depicts side beams 15 positioned about inner surface 17 of side wall panels 13. However, it is to be understood that side beams 15 may also be positioned about outer surface 31 of side wall panels 13. In addition, more than one side beam 15 may be positioned on each side wall panel 13. For example, each side wall panel 13 may have from two to five side beams 15 positioned therewith. The number of side beams 15 positioned on each side wall 13 depends upon load factors which will be further described herein. In addition, it is not necessary that each side wall panel 13 contain the same number of side beams 15.

FIG. 1 also depicts side beams 15 extending substantially vertically about inner surface 17 of side wall panels 13. Preferably, side beams 15 may be positioned at an angle in the range of 10 to 90 degrees in relation to bottom panel 12. More preferably, side beams 15 may be positioned at an angle in the range of 45 to 90 degrees in relation to bottom panel 12. And even more preferably, side beams 15 may be positioned at an angle of about 90 degrees in relation to bottom panel 12. Preferably, side beams 15 extend substantially the entire height of each of side wall panels 13.

To effect distribution of the lateral bulge forces, it is preferable that side beams 15 be formed of a substantially rigid material. The rigid material forming side beams 15 may be any material having rigidity such that the distribution of lateral bulge forces is accomplished. Preferably, such rigid material is corrugated paper, wood, plastic or metal. Side beams 15 may also be designed in a variety of shapes. For example, side beams 15 may be tubular. In addition, side beams 15 may be triangular shaped or V shaped in cross section.

Side beams 15 should be positioned about side wall panels 13 in order to effect an equal diversion of the lateral bulge force. In the square or rectangular shaped bulk container of the present invention, equal diversion of the lateral bulge force would occur about the center of each side wall panel 13. Hence, it is preferred to position side beams 15 at or near the center of each side wall panel 13 as shown in FIG. 1, especially if only one side beam 15 is positioned per side wall panel 13. In an embodiment of the present invention in which two or more side beams 15 are positioned per side wall panel 13, it is preferred that side beams 15 be positioned off center of each side wall panel 13.

Figure 3:
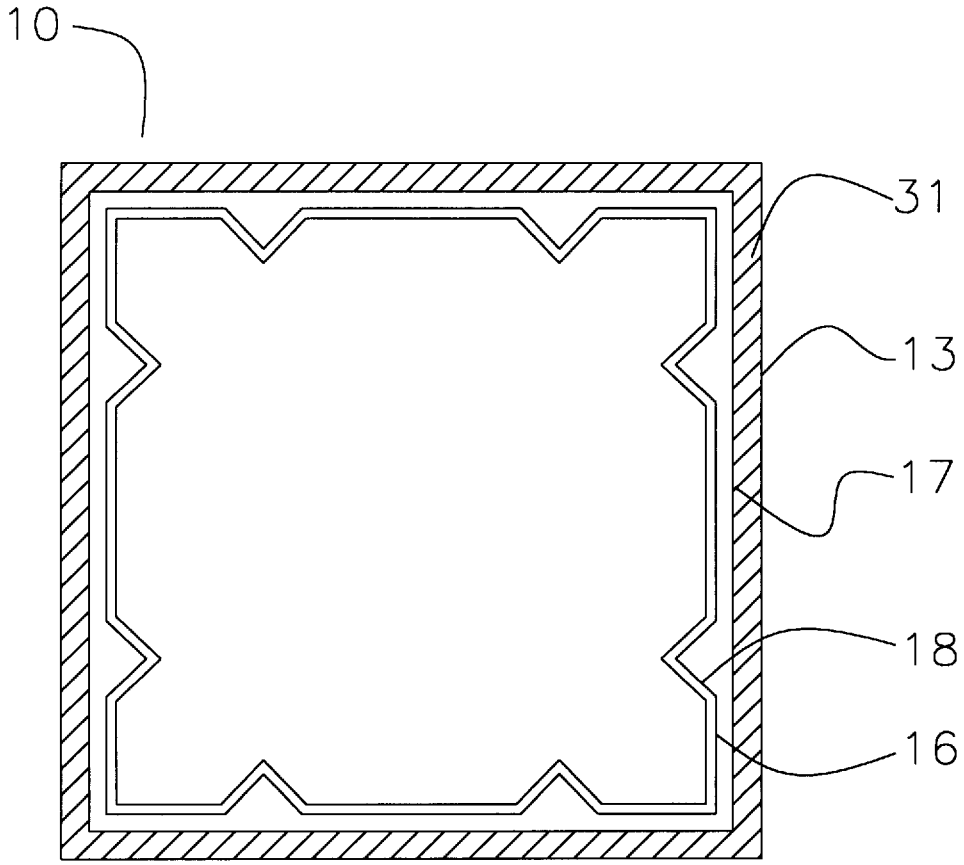
FIG. 3 is a top schematic view of a second embodiment of the bulk box container showing the placement within the chamber of the container of a rigid inner lining containing folds which form the side beams.

Side beams 15 may be positioned about side wall panels 13 in numerous ways. As illustrated in FIG. 3, side beams 15 may be integrated with or form part of a rigid inner lining 16. Inner lining 16 may be positioned within chamber 14, sitting adjacent to inner surface 17 of side wall panels 13. Preferably, inner lining 16 is layer of corrugated paper board and side beams 15 are formed as folds 18 in inner lining 16. Inner lining 16 may be a non detachable component part of side wall panels 13 in which case it is formed as part of side wall panels 13 or as a unit which is permanently fastened (e.g., by adhesive or stapling) to inner surface 17 of side wall panels 13. However, it is preferred if inner lining 16 is a detachable unit which separates from side wall panels 13 and is removable from chamber 14 of box 10.

In another embodiment of the bulk box container, side beams 15 may be formed as an integrated part of side wall panels 13. Side beams 15 may be formed in this embodiment by molding, pressing or folding side wall panels 13 into the desired configuration to create side beams 15.

Side beams 15 may be held in position about side wall panels 13 by various retaining means 22. For example, side beams 15 may be attached directly to side wall panels 13 or side beams 15 may be directly attached to top panel 11 and bottom panel 12. The type of retaining means 22 provided may be dictated by the type of material forming box 10. In the embodiment of the present invention in which side beams 15 are fixedly attached to side wall panels 13, retainer means may be an adhesive. In an alternative embodiment of the invention in which box 10 is made of metal, retainer means may be a weld.

Alternatively, retainer means 22 may function to receive and maintain side beams 15 in a substantially vertical position about side wall panels 13. Preferably in this embodiment, retainer means 22 are configured as sleeves 26.

Figure 4:
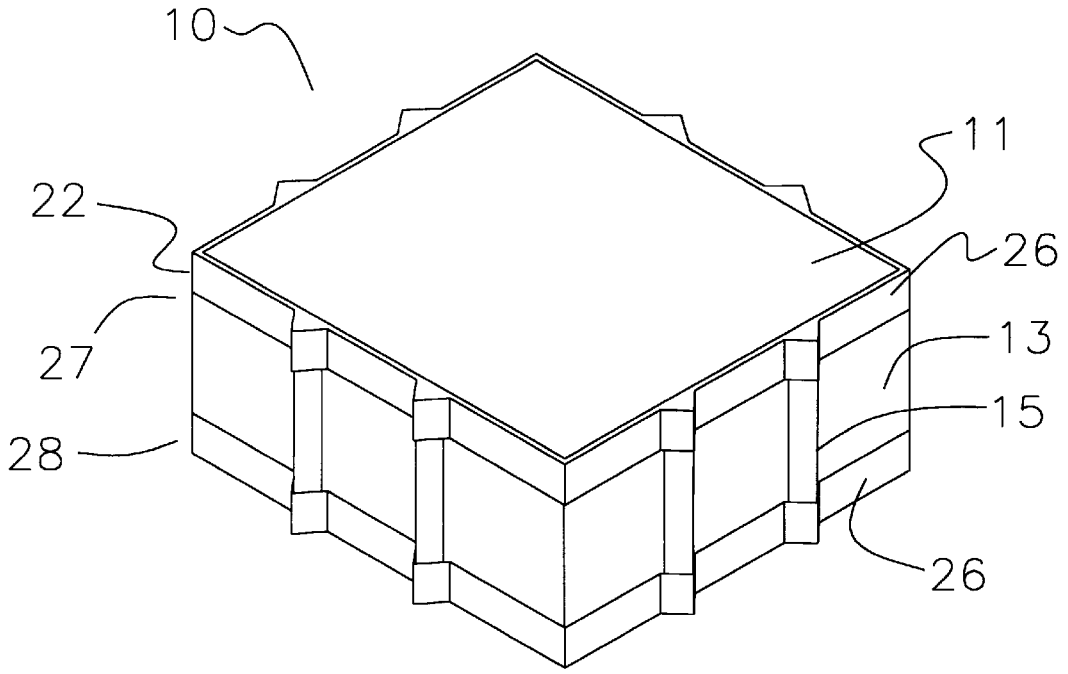
FIG. 4 is an isometric view of a third embodiment of the bulk box container showing the side beams positioned about the outer surface of the side wall panels via sleeves.
Figure 5:
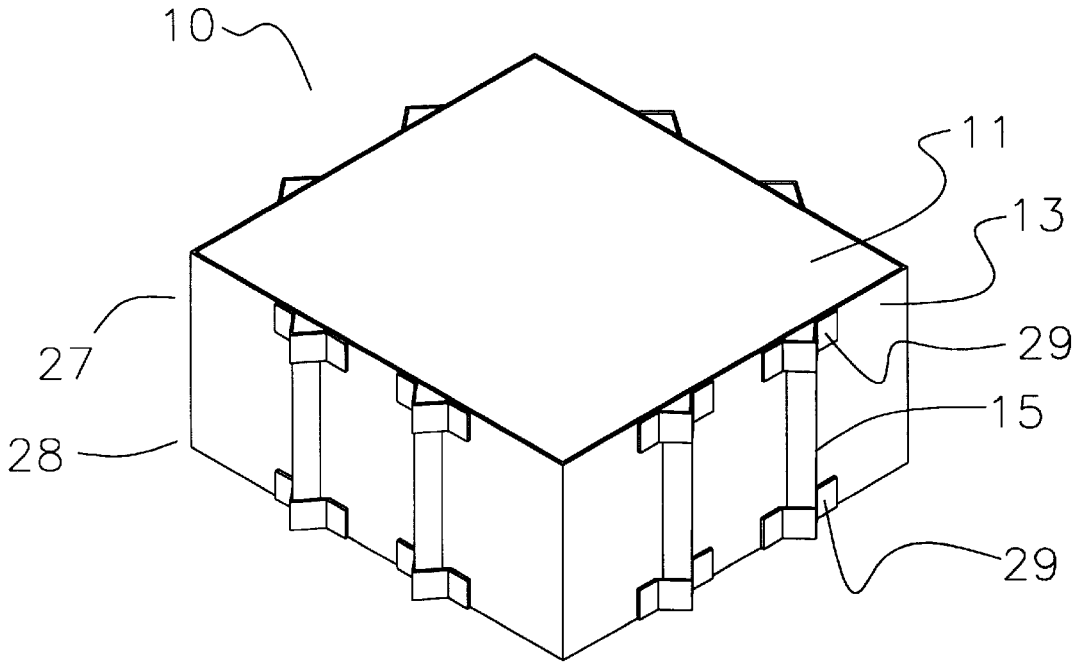
FIG. 5 is an isometric view of the third embodiment of the bulk box container showing the side beams positioned about the outer surface of the side wall panels via pockets.

With reference to FIG. 4, sleeves 26 may be secured to side wall panels 13. In one embodiment of the present invention, sleeves 26 are positioned at top end 27 and bottom end 28 of each of side wall panels 13 whereby the ends of side beams 15 are fixedly attached to side wall panels 13. Sleeves 26 may extend continuously around side wall panels 13 at top end 27 and bottom end 28. However, sleeves 26 may also extend non-continuously around side wall panels 13 at top end 27 and bottom end 28. Preferably, sleeves 26 are in the form of multiple pockets 29 whereby a set of two pockets 29, one positioned at bottom end 28 and one positioned at top end 27, receive and maintain individual side beams 15 in a substantially vertical position about side wall panels 13, as shown in FIG. 5.

Sleeves 26 may be secured to side wall panels 13 by conventional means depending on the material forming sleeves 26. For example, sleeves 26 may be made of a flexible, non-elastic material, preferably a synthetic material, a polypropylene material or a polyethylene material. Sleeves 26 made of a flexible, non-elastic material may be secured to side wall panels 13 by conventional fastening means, as for example, mechanical fastening. For illustrative purposes, mechanical fastening may be stapling.

Figure 6:
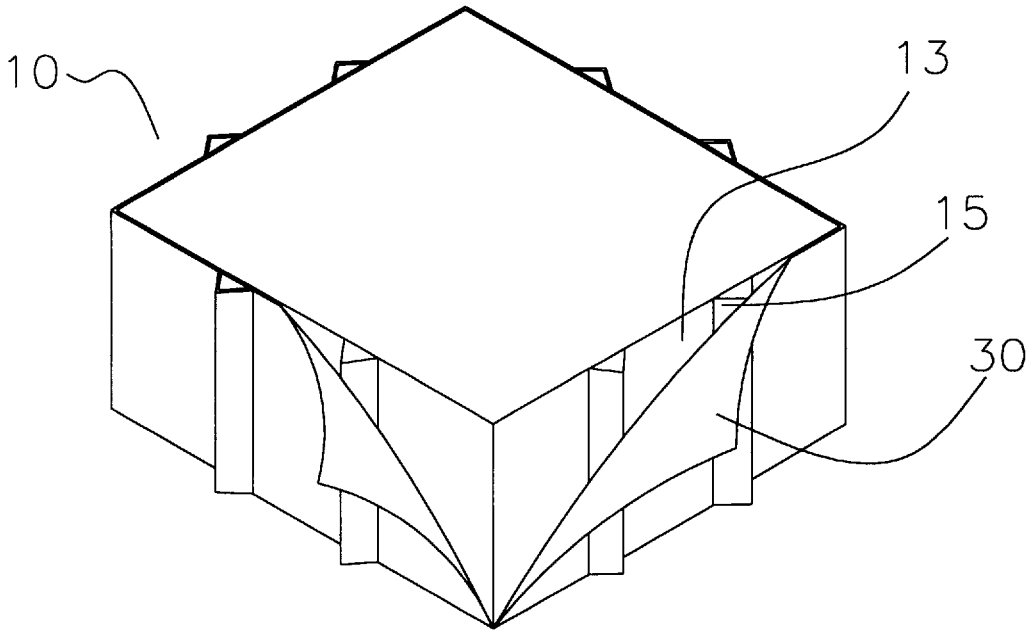
FIG. 6 is an isometric view of the third embodiment of the bulk box container showing the side beams positioned about the outer surface of the side wall panels via a laminating sheet.

In yet another preferred embodiment shown in FIG. 6, sleeves 26 may be in the form of sheet 30. Preferably, sheet 30 forms a laminate which substantially covers side wall panels 13 and side beams 15 as they are positioned about side wall panels 13. Sheet 30 may be fastened to side wall panel 13 by various conventional means such as adhesive and stapling. Moreover, sheet 30 may extend continuously around side wall panels 13 to form the laminate or sheet 30 may extend noncontinuously around side wall panels 13 to form the laminate. In the latter configuration, sheet 30 may be composed of separate sheets covering portions of side wall panels 13.

Figure 7:
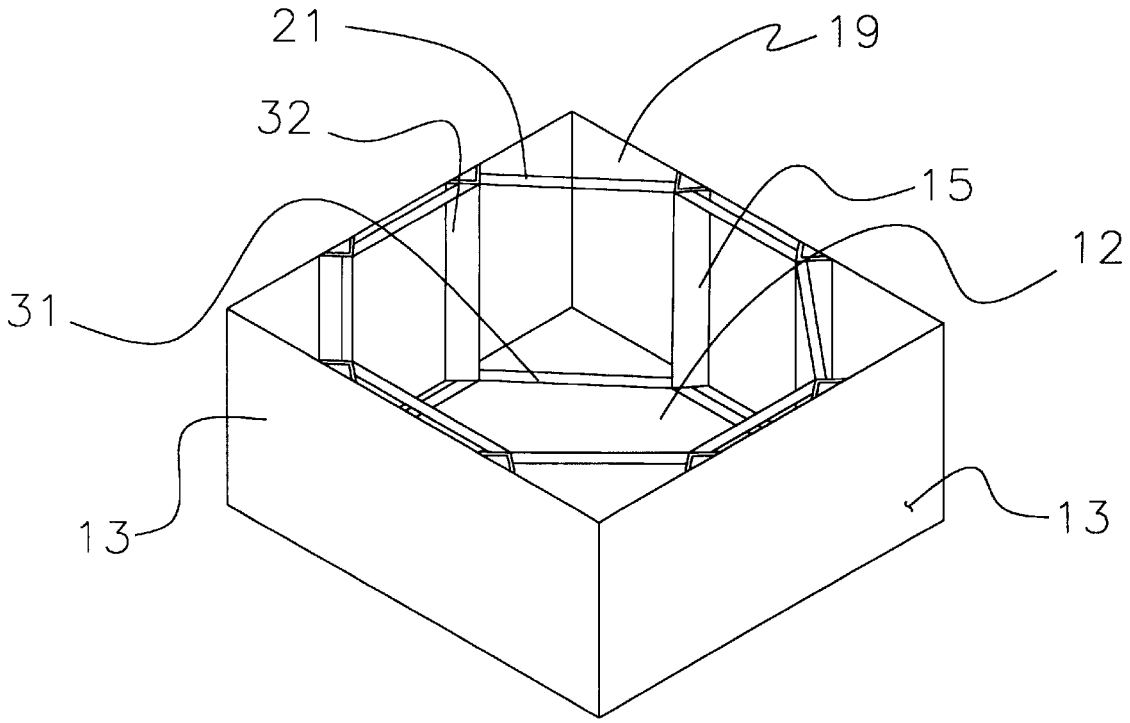
FIG. 7 is an isometric view of a fifth embodiment of the bulk box container showing the interconnection of the top and bottom ends of side beams via straps.

FIG. 7 illustrates another embodiment of the present invention. In this embodiment, top force distribution means 19 interconnect top ends 20 of side beams 15. Bottom force distribution means 31 may also be provided to interconnect bottom ends 32 of side beams 15. Top and bottom force distribution means 19, 31 function to evenly distribute the lateral forces throughout box 10 and specifically to all side beams 15. Preferably, top force distribution means 19 connect adjacent top ends 20 of side beams 15 to each other, and bottom force distribution means 31 connect adjacent bottom ends 32 of side beams 15 to each other.

Top and bottom force distribution means 19, 31 may be any device which provides for the interconnection of side beams 15 and functions to distribute the lateral forces as aforesaid. Examples may include wires and other preformed rigid material. Preferably, top and bottom force distribution means 19, 31 are in the form of straps 21 made of a non elastic material. In the embodiment just described, retainer means 22 may also position or attach side beams 15 to side wall panels 13.

Figure 8:
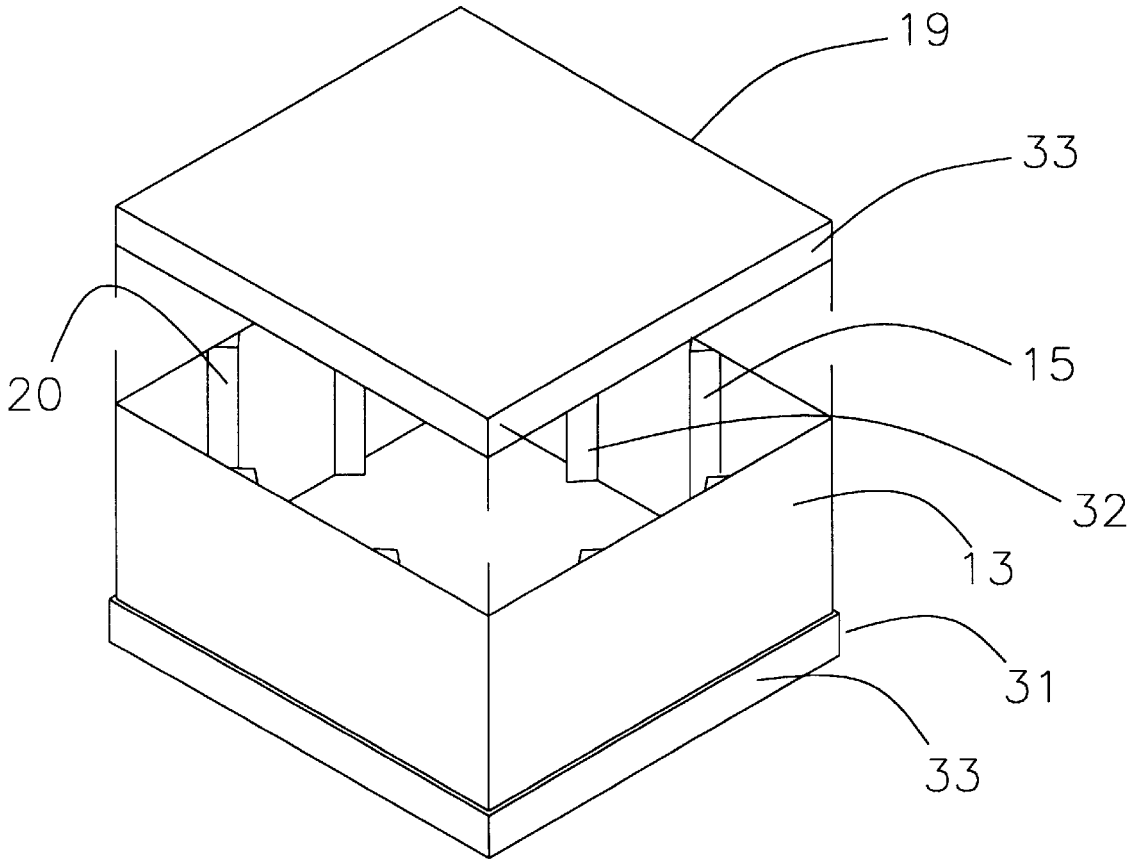
FIG. 8 is a isometric, cut away view of the fifth embodiment of the bulk container showing the interconnection of the top and bottom ends of side beams via a top and bottom lid.

Top and bottom force distribution means 19, 31 may also be in the form of top and bottom container lids 33 as shown in FIG. 8. Top and bottom lids 33 would rest against respective top and bottom ends 20,32 of side beams 15 and hold side beams 15 in place about side wall panels 13. Side beams 15 may be attached or unattached to side wall panels 13. Preferably, top and bottom lids 33 form top and bottom panels 11, 12, respectively.

Top and bottom force distribution means 19, 31 (e.g., straps 21) cause side beams 15 to be relatively restricted from moving when chamber 14 is filled with flowable materials. As a result, a force exerted in any direction on one of side beams 15 would be countered by an opposite force caused by the same force on one or more of the other side beams 15. Hence, a stabilized equal distribution of forces results. In other words, any outward bound force exerted on a side beam 15 by a force exerted by the lateral force bulge force on side wall panel 13 is transmitted to top and bottom ends 20, 32 of side beams 15 and then is transmitted through top and bottom force distribution means 19, 31 to other side beams 15. Since side beams 15 are equally stressed and held in place, box 10 has a fixed dimensional stability. Preferably, eight side beams are used in this embodiment, and top and bottom force distribution means 19, 31 would resemble an octagon which would connect eight geometrical spaced side beams 15 at the top and bottom of box 10 resulting in a stable condition of resistance against all directional stresses.

The bulk container of the present invention may be constructed by providing a rigid top panel 11 and a rigid bottom panel 12. Four rigid side wall panels 13 are then connected to top panel 11 and bottom panel 12 to create a chamber 14 for flowable materials. At least one rigid side beam 15 is positioned about each of side wall panels 13 in a substantially vertical position whereby side beams 15 provide lateral support for box 10 to prevent bulging thereof when chamber 14 contains flowable materials. Retainer means 22 may be utilized to accomplish the positioning of side beams 15 about side wall panel 13. Preferably, two side beams 15 are positioned substantially vertically about each of side wall panels 13.

The present invention has utility for a variety of rigid containers. It is foreseen that one application of the present invention will be with rigid intermediate bulk shipping containers. These containers customarily hold between 1,000 and 3,000 lbs. or more of material and are made of paper board. Preferably, box 10 may hold about 2,000 lbs. of bulk material for a 1 to 1.5 cubic yard quantity.

While preferred embodiments of the present invention have been described, it is to be understood that the embodiments described are illustrative only and that the scope of the invention is to be defined solely by the appended claims when accorded a full range of equivalence, many variations and modifications naturally occurring to those skilled in the art from a perusal hereof.

What is claimed is:

1. A bulk container, comprising:

a box made of substantially rigid packaging material comprising a top and a bottom panel interconnected by four side wall panels defining a chamber for flowable materials, said flowable materials creating a force acting against said 4 side wall panels;

four side beams extending substantially vertically about each of said four side wall panels, said 4 side beams being connected to said top and bottom panel so that the force exerted by said flowable materials on said 4 side beams will be countered by an opposing force to prevent bulging thereof when said chamber contains said flowable materials.

2. The bulk container according to claim 1, wherein two side beams extend substantially vertically about each of said four side wall panels.

3. The bulk container according to claim 1, wherein said side beams are positioned at an angle in the range of 10 to 90 degrees in relation to said bottom panel.

4. The bulk container according to claim 3, wherein said side beams are positioned at an angle in the range of 45 to 90 degrees in relation to said bottom panel.

5. The bulk container according to claim 4, wherein said side beams are positioned at an angle of 90 degrees in relation to said bottom panel.

6. The bulk container according to claim 1, wherein said side beams extend substantially the entire height of said four side wall panels.

7. The bulk container according to claim 1, wherein said side beams are formed of a substantially rigid material.

8. The bulk container according to claim 7, wherein said rigid material is selected from the group consisting of corrugated paper, wood, plastic and metal.

9. The bulk container according to claim 8, wherein said side beams are tubular.

10. The bulk container according to claim 8, wherein said side beams are triangular shaped in cross section.

11. The bulk container according to claim 8, wherein said side beams are V shaped in cross section.

12. The bulk container according to claim 1, wherein said packaging material is selected from the group consisting of paper board, plastic, wood and metal.

13. The bulk container according to claim 1, wherein said side beams are integrated with a rigid inner lining, said inner lining being positioned within said chamber and adjacent to an inner surface of each of said four side wall panels.

14. The bulk container according to claim 13, wherein said rigid inner lining is corrugated paper board.

15. The bulk container according to claim 14, wherein said side beams are folds in said inner lining.

16. The bulk container according to claim 13, further comprising a top force distribution means connecting a top end of each side beam to top ends of adjacent side beams.

17. The bulk container according to claim 16, further comprising a bottom force distribution means connecting a bottom end of each side beam to bottom ends of adjacent side beams.

18. The bulk container according to claim 17, wherein said top and bottom force distribution means are straps formed of a non elastic material.

19. The bulk container according to claim 17, wherein said top and bottom force distribution means are respective top and bottom container lids.

20. The bulk container according to claim 19, wherein said container lids form said top and bottom panels.

21. A method of constructing a bulk container, comprising the steps of:

(a) providing a box made of substantially rigid packaging material having top and bottom panels interconnected by four side wall panels defining a chamber for flowable materials, said flowable materials producing a force against said side wall panels;

(b) positioning at least one rigid side beam to each of said four side wall panels in a substantially vertical position; and (c) interconnecting said top and bottom panel with said rigid side beams so that the force on said side beams is countered by an opposite force caused by the same force on said opposite side beam.

22. The method of constructing a bulk container according to claim 21, further comprising the step of providing retainer means to accomplish the positioning step of paragraph (b).

23. The method of constructing a bulk container according to claim 21, wherein two side beams extend substantially vertically about each of said four side wall panels.

24. The method of constructing a bulk container according to claim 21, wherein said packaging material is selected from the group consisting of paper board, plastic wood and metal.

* * * * *